US009187159B2

(12) United States Patent
Mukhortov

(10) Patent No.: US 9,187,159 B2
(45) Date of Patent: Nov. 17, 2015

(54) LIFE SAVING WRISTBAND (VARIANTS) AND GAS-GENERATOR (VARIANTS)

(71) Applicant: Pavel P. Mukhortov, Mytischi (RU)

(72) Inventor: Pavel P. Mukhortov, Mytischi (RU)

( * ) Notice: Subject to any disclaimer, the term of this patent is extended or adjusted under 35 U.S.C. 154(b) by 0 days.

(21) Appl. No.: 14/229,939

(22) Filed: Mar. 30, 2014

(65) Prior Publication Data

US 2015/0251738 A1 Sep. 10, 2015

(51) Int. Cl.
*B63C 9/15* (2006.01)
*B63C 9/08* (2006.01)
*B63C 9/13* (2006.01)

(52) U.S. Cl.
CPC ..... *B63C 9/155* (2013.01); *B63C 9/081* (2013.01); *B63C 2009/131* (2013.01)

(58) Field of Classification Search
CPC ..... B63C 9/1255; B63C 9/155
USPC ..... 441/92, 122
See application file for complete search history.

(56) References Cited

U.S. PATENT DOCUMENTS 4,629,436 A * 12/1986 Stewart ..... B63C 9/155 222/5
5,374,212 A * 12/1994 Lall ..... B63C 9/155 441/122
5,421,760 A * 6/1995 Blaga ..... B63C 9/155 441/123
5,823,840 A * 10/1998 Powers ..... B63C 9/23 441/122
5,921,832 A * 7/1999 Thiermann ..... B63C 9/24 441/41
6,805,599 B1 * 10/2004 Huang ..... B63C 9/155 441/122
7,264,525 B2 * 9/2007 Tsitas ..... B63C 9/155 441/90
7,267,509 B1 * 9/2007 Jackson, III ..... B63C 9/155 405/186
7,854,347 B2 * 12/2010 Wang ..... B63C 9/24 141/329
8,016,627 B2 * 9/2011 Andrea ..... B63C 9/155 441/122
8,920,205 B2 * 12/2014 McCarthy ..... B63C 9/00 441/92
8,961,250 B2 * 2/2015 Meyer ..... B63C 9/18 441/31
2009/0130933 A1 * 5/2009 Andrea ..... B63C 9/155 441/94
2012/0034831 A1 * 2/2012 Andrea ..... B63C 9/155 441/93
2012/0244767 A1 * 9/2012 Senn ..... A45F 5/00 441/92
2013/0295804 A1 * 11/2013 Senn ..... B63C 9/155 441/92

* cited by examiner

*Primary Examiner* — Lars A Olson
*Assistant Examiner* — Jovon Hayes
(74) *Attorney, Agent, or Firm* — Inventa Capital PLC

(57) ABSTRACT

The invention refers to sea rescue, in particular, to an individual wearable buoyant apparatuses that may be used on beaches, in emergency situations, and on vessels as an individual lifesaver for self-rescue in water, affordable and easy to use for everyone. The rescue wristband consists of elastic inflatable buoyant camera, tightly rolled and compactly packed into a pocket running along the wristband perimeter. System for filling in the chamber is designed as gas generator device emitted the required volume of carbonic gas as result of chemical reaction chemical components safe for human, startup of filling system initiates by hand compression or by excessive pressure of definite depth. If the chamber is filled in with gas, it expands from the pocket and forms C-shape form and can be designed in various versions.

10 Claims, 2 Drawing Sheets

LIFE SAVING WRISTBAND (VARIANTS) AND GAS-GENERATOR (VARIANTS)

This application claims priority to Russian patent application serial number RU2014108718 filed on Mar. 7, 2014, and incorporated herewith by reference in its entirety

FIELD OF INVENTION

The invention refers to sea rescue (a miniature compact device that ensures rescue to a swimmer, both a beginner and an experienced swimmer, is case he/she loses buoyancy) and, in particular, to an individual wearable buoyant apparatuses that may be used on beaches, in emergency situations, and on vessels as an individual lifesaver for self-rescue in water, affordable and easy to use for everyone. Also, it may be considered as means of additional buoyancy for free divers for emergency surfacing from the deepness.

BACKGROUND OF THE INVENTION

A device for sea rescue is known that contains an inflatable element that comprises a belt with a buckle and a vessel with compressed gas connected to an end of the inflatable element and containing a wall that separates the volumes of the vessel and the inflatable element and the design of the wall includes a destructible part (Russian patent No. 2094299, class B63C 9/15, published on 27 Oct. 1997).

Another device for sea rescue is known that contains rescue bracelet that comprises inflatable elastic buoyant camera tightly rolled and placed into a pocket running along the wristband perimeter, system of gas filling in camera, look for example, as balloon with compressed gas and mechanism for start of system of gas filling, equipped by exhaust cord. Buoyant camera is designed to became C-shape form being filled, came unfolded and featured by length adjusted fastener (Russian patent No. 126312, class B63C9/08 (2006.01), published on 27 Mar. 2013).

Disadvantages of this lifesaver are that it can be filled by compressed gas from balloon and safety of this system is suffering from external impact, for example, direct sun radiation exposes to explode it due excessive overheat. So, balloon should be manufactured with thick-wall shell for safety purposes.

The objective of the invention was to create a more comfortable, cheap and safe individual lifesaver that would be compact and small weight with more high level of safety when it is used in comparison with known technical solution.

SUMMARY OF THE INVENTION

The goal of the proposed invention is to make swimming or bathing in an open air water reservoir more comfortable and safe owing to the usage of more smaller size and reducing weight of the rescue wristband worn on the body. It may be fixed both on the swimmer's wrist or forearm using different fasteners chosen depending on the swimmer's preferences or be fixed in a special way on the swimmer's trunks ensuring, if required, rapid activation of the inflatable buoyance chamber to maintain the upper part of the swimmer's body above the water surface.

The specified goal is accomplished through the rescue wristband containing a length-adjustable fastener band with a buckle (or touch-fastener or a rubber band whose length may be adjusted without a buckle or is designed as a bundle without a buckle), an inflatable elastic buoyance chamber tightly rolled and placed into a pocket running along the wristband perimeter, a system for filling the chamber with gas that is designed, for example, as a gas generator, producing required volume of carbonic acid (gas) as result of chemical reaction between 2 or more safe for men (in occasional contact with skin) components and a device for activating the filling-in system without a lanyard. Start-up of gas generator reaction can be occurred by 3 means: by handy sharp compression to special convex spot on rescue wristband or by bending of compact unit on the swimmer's trunks or by self-starting of gas generator on definite level of depth of submergence (case of self-start under the excessive pressure of water on definite depth when swimmer has lost the consciousness).

If the chamber is filled in with gas, it expands from the pocket and form (depends on layout and styling of camera) C-shape or an almost circular chamber filled-in with gas. The size of rescue wristband may be adjusted to the swimmer's arm. Compact unit which is usually is fixed to swimmer's trunks may by located on neck (back or front position) and support the head under the water as C-shape pillow. Safe for men chemical components can be chosen as next: baking soda, water, various hydrogen carbonates and carbonates, weak solutions of carbon acids or vinegars (during the gas-filling process the harmful and toxic substances should not be emitted).

The gas generator should be manufactured with thin-wall plastic materials or polyethylene and should consists of 2 hermetic isolated sections. Partition between the sections should be or membrane easy destroyed under pressure/or high tech membrane with lost-impenetrable ability under excessive pressure of hand or plunger inside the sections. Water and mixed in water chemical component is filled in one section, another chemical component (as water solution for more quick speed of reaction) is filled in second one. While mixed and reacted both components are emitting the carbonic acid. Inflatable elastic buoyant camera should be manufactured from water-proof material (for example, nylon with polyurethane coating, polyurethane film 0.2 mm thick, soft or durable PVC) and may be consisted by different sections.

In this case, filled gas in rescue wristband forms several ball-shaped, C-shaped or oblong bodies and utilization of it becomes more convenient. The technical result of the universal compact rescue wristband that may be used as an individual lifesaver, expressed in higher safety in utilization, reduced size and weight, in cost-efficient way of production, with comfort owing to easy activation due the implementation of gas generator balloon made of thin wall plastic or polyethylene with emission carbonic acid under chemical reaction of 2 or more safe for men components.

In emergency case rescue wristband can be easily activated and adjusted to size of forearm using adjustable fastener or adjustable length of fastener's belt or elastic wisp as fastener. The rescue wristband may be designed in various versions differing by the shapes of buoyant camera employed. Presence of the new features differing from the prototype indicates that the proposed technical solution complies with the 'novelty' requirements.

The rescue wristband (1) represents as hollow, gas filled, inflatable buoyant camera (2), tightly rolled and compactly packed into a pocket running along the wristband perimeter. Buoyant camera should be made from gas-proof material in form of open-end ring. Rescue wristband has plug-in lock (3), designed in various versions (with adjustable length fastener-knob; with adjustable micrometric fastener; with adjustable length fastener-buckle; with adjustable length fastener flypaper or elastic wisp as fastener). Buoyant camera may be differed in volume dimensions: for swimmer-child with weight up to 20 kg—volume is 3000 ml; for swimmer with big weight—volume is around 5000 ml. Version of rescue wristband with fixation to swimmer's trunks should have 1.5 l volume to fit European standard for saving life jacket.

The system that fills the chamber with gas (4) may be designed as, for example, a gas generator with emission of required volume of gas as result of chemical reaction between chemical components safe for human health. Gas generator be designed in different shapes that allow the device to have small dimensions, be attractive, and look like a decoration—as a balloon and not thick plate or as a wrist watch casing). The device starts up by simple sharp compression of wrist band in spot of gas-generator location or upon excessive pressure and activates the filling-in system. Buoyant camera expands from the pocket when the chamber is filled with gas and takes the form of a C-shaped buoyancy chamber on the ends of which a length-adjustable fastener is fixed. The inflated chamber is additionally fixed to the arm and is pressed to it. While gas generator starts up, system be filled the gas during 3-10 seconds. Rescue wristband can be equipped by the valve for blowing mouth.

On the ends of the wristband made of a watertight material a length-adjustable band with a fastener or a length-adjustable fastener is fixed that is used to fix the wristband on the man's wrist or forearm. One of the version of wristband (when it is fixed on swimmer's trunks) may by located on neck (back or front position) and support the head under the water as C-shape pillow. Therefore, when swimming in a water reservoir, the rescue wristband looks like a regular bracelet; it allows the user to swim not putting his/her life under hazard and always having handy a rescue buoy that will keep the swimmer on the surface, help him/her reach the shore, and is easily noticeable, owing to its bright color, to potential rescuers.

The wristband may be designed as an extendable bundle (FIG. 2) without a fastener and have instead a clip-type fixing device (7) one end of which is fixed to the wristband and the free end is fixed to swimming trunks. In case of danger, the swimmer can rapidly unfasten the wristband from the swimming trunks and put it on his/her own or other swimmer's hand having passed the hand through the tightened bundle ring; if used permanently during swimming, such tightening would be uncomfortable; however, if used for a short time during the period of danger, this is a reliable way of fixing the wristband on the arm that only requires for fixing to pass the hand through the device. The rescue wristband operates in the following way:

The user puts the safety wristband on the arm (on the wrist like wrist watch or on the forearm as a decorative band similar to how children put on swimming-aid sleeves; but the wristband is not inflated) and fixes the fastener having adjusted it to the arm size. Or swimmer can fix the device to trunks. If necessary, the user should activate the rescue wristband to the working state. To do so, he must sharply press to special convex spot on rescue wristband and start up the chemical reaction of gas emission. The hollow buoyance chamber is filled then with gas and takes the form of a life ring, C-shape pillow or sleeves (like those used by children), owing to which the user can stay afloat for a long time (waiting to be rescued or swimming to the shore). When the rescue wristband becomes unnecessary, it can be unfixed and left in water.

DETAILED DESCRIPTION OF THE INVENTION

Figure 1:
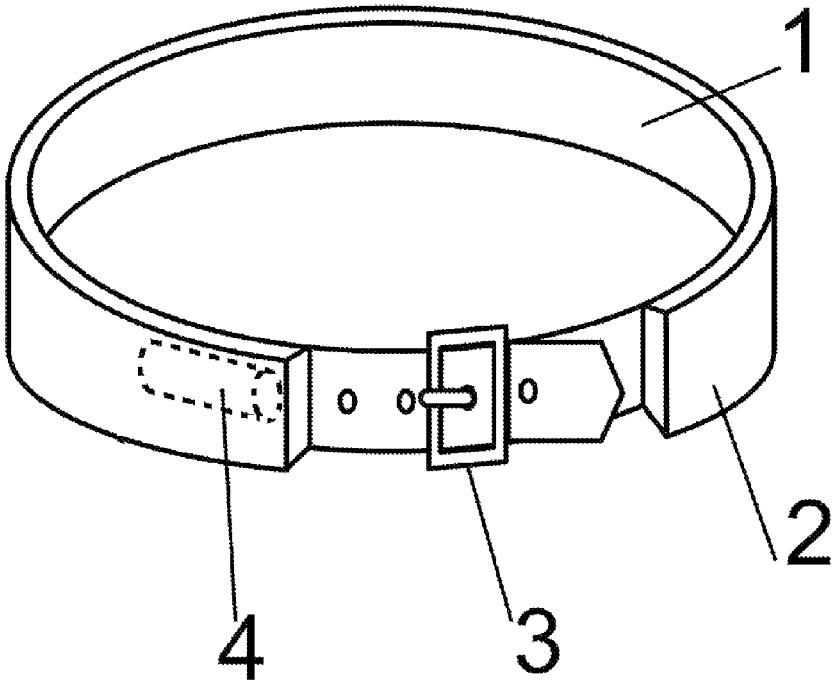
FIG. 1 presents common view of rescue wristband in initial form.
Figure 2:
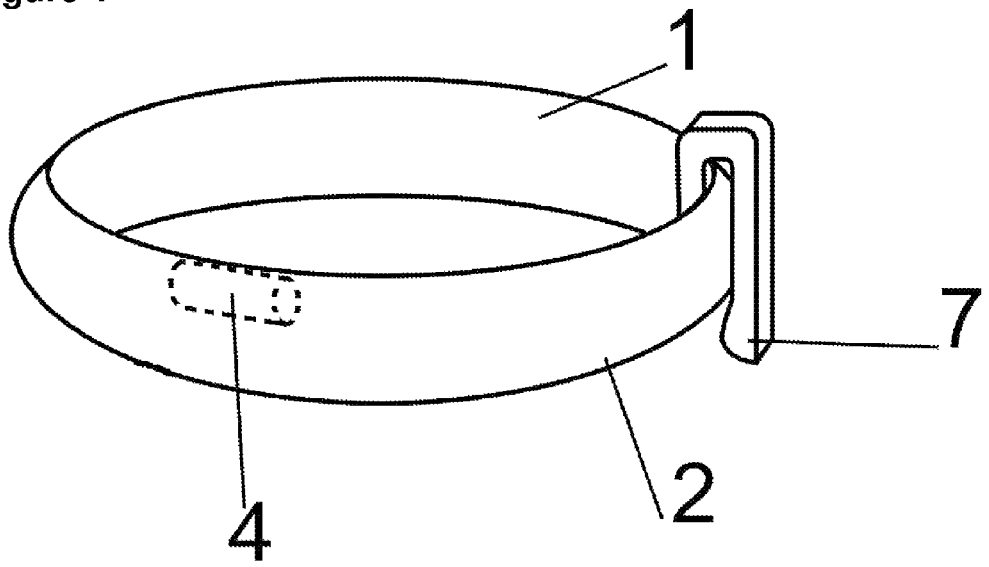
FIG. 2 presents common view of rescue wristband—version when it is designed as an elastic bundle and has a clip-type fastener.
Figure 3:
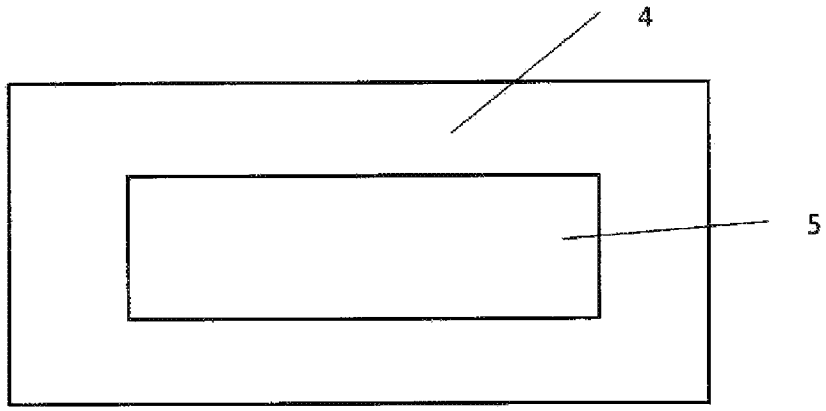
FIG. 3 presents gas generator (version 1)

The gas generator should be manufactured with thin-wall plastic materials or polyethylene in 2 versions of design. The gas generator (FIG. 3 version 1) consists of hermetic capsule (4) made of thin-wall plastic or polyethylene and placed inside buoyant camera (2). One more capsule of smaller size (5) is placed inside capsule (4) made of thin-wall plastic or polyethylene (FIG. 3). Water with baking soda is filled inside capsule (4). Aqueous solution of citric acid is filled inside capsule (5). Capsule (5) is made as easy-destroyed while compression and liquid from capsule (5) mixes with liquid from capsule (4), chemical reaction occurs, carbonic acid emits and destroys (if it's not happened in compression moment) the walls of capsule (4), fills the hollow volume (2) of buoyant camera, but gas generator still is located inside the camera.

Figure 4:
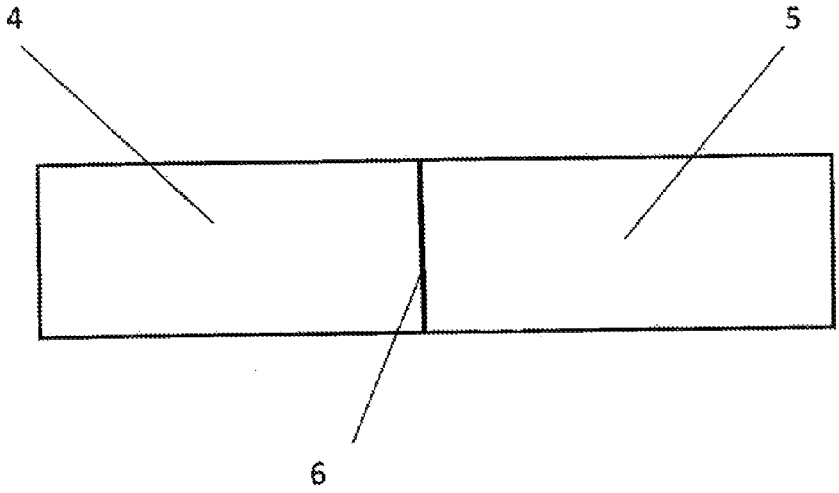
FIG. 4 presents gas generator (version 2).

The gas generator (FIG. 4 version 2) consists of 2 hermetic capsule (4) and (5) placed inside buoyant camera (2). Capsules are made of thin-wall plastic with membrane (6) between it made of easy-destroyed polyethylene. Water with baking soda is filled inside capsule (4). Aqueous solution of citric acid is filled inside capsule (5). Membrane (6) is made as easy-destroyed while compression and liquid from capsule (5) mixes with liquid from capsule (4), chemical reaction occurs, carbonic acid emits and destroys (if it's not happened in compression moment) the walls of both capsules, fills the hollow volume (2) of buoyant camera, but gas generator still is located inside the camera.

Examples of emission of carbonic acid as chemical reaction between safe for human components. Water in chemical reaction is used for dissolving of the dry chemical components and fastening of reaction.

Gas generator can be used for other household items.

Example 1

Emission of Carbonic Acid as Mixture of Chemical Components of Baking Soda and Citric Acid, Mixed with Water Components Parameters:

| Baking soda | |
|---|---|
| Total information | |
| Systematic name | sodium bicarbonate |
| Traditional name | Baking soda, soda bicarbonate |
| Chemical formula | $NaHCO_3$ |
| Empiric formula | $CHO_3Na$ |
| Physical qualities | |
| State | solid |
| Relative molecular mass | 84 |
| Molar mass | 84.007 g/mol |
| Density | 2.159 g/sm$^3$ |
| Thermal properties | |
| Decomposition temperature | 60-200° C. |
| Chemical qualities | |
| Water solubility | 9.59 g/100 ml |

| Citric acid | |
|---|---|
| Total information | |
| Systematic name | 2-hydroxy-1,2,3-propane-three-carboxylic acid |
| Traditional name | Citric acid (2-hydroxy-1,2,3-propane-three-carboxylic acid) |
| Chemical formula | $C_6H_8O_7$ |
| Physical qualities | |
| State | solid |
| Molar mass | 192.1 g/mol |
| Density | 1.665 g/sm$^3$ |
| Thermal properties | |
| Decomposition temperature | 175° C. |
| Chemical qualities | |
| Water solubility | 133 g/100 ml |

Component Content:

10.0 g $NaHCO_3$+7.68 g $C_6H_8O_7$=5.28 g (2.71) $CO_2$+2.16r (2 ml) $H_2O$+10.32 g $Na_3C_6H_5O_7$ i.e. each 10 g of soda needs 7.68 g of acid, and as catalyst for reaction fastening 40 ml of water should be used for each new portion of components.

2.7 liters of carbonic gas is emitted

Chemical Reaction

3NaHCO3+C6H8O7=3CO2+3H2O+Na3C6H5O7

Result of reaction are aqueous solution of the citrate (non harmful component, food additive E331) and carbonic gas in volume able to inflating rubber ball up to 2700 ml.

Example 2

Emission of Carbonic Acid as Mixture of Chemical Components of Calcium Carbonate and Citric Acid, Mixed with Water Components Parameters:

| Calcium carbonate | |
|---|---|
| Total information | |
| Systematic name | calcium carbonate |
| Traditional name | calcium carbonate |
| Chemical formula | $CaCO_3$ |
| Physical qualities | |
| State | solid white crystals |
| Relative molecular mass | 100.0869 g/mol |
| Molar mass | 2.74 g/sm$^3$ (tiff)<br>2.83 g/sm$^3$ (aragonite) |
| Thermal properties | |
| Decomposition temperature | 900-1000° C. |
| Chemical qualities | |
| Water solubility | 0.00015 g/100 ml |

Citric acid (see example 1)

Component Content:

Calcium carbonate—10 g.

Citric acid—12.8 g.

Water—2 ml

Chemical Reaction $$3CaCO_3+2C_6H_8O_7=3CO_2+3H_2O+Ca_3(C_6H_5O_7)_2$$

Result of reaction are aqueous solution of the calcium citrate and carbonic gas in volume able to inflating rubber ball up to 2200 ml.

Thus, the gas-filled buoyancy chamber saves the swimmer from drowning in a critical situation and thus prevents water accidents. The design of the proposed rescue wristband may be attractive. Due to simple design and small dimensions, the cost of the device is not high. Absence of metallic parts in gas generator excludes the corrosion reaction and provides the long term of service. The proposed device may be widely used as a lifesaver on riverine and marine vessels and as an individual lifesaver for swimmer and bathers.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A rescue wristband comprising:

an inflatable elastic buoyance chamber tightly rolled and placed in a pocket along the wristband perimeter and presenting a form of at least one of C-shape and O-shape, a fastener with adjustable length, and a gas generator defined by an outer capsule filled with a first solution and an inner capsule filled with a second solution, the outer capsule and the inner capsule located inside the inflatable elastic buoyance chamber and separated from one another whereby as the separation is destroyed by a pressure, the reaction between the second solution released from the inner capsule and mixed with the first solution produced gas that fills the inflatable elastic buoyance chamber thereby inflating the inflatable elastic buoyance chamber as the inner capsule and the outer capsule are located inside the inflatable elastic buoyance chamber.

2. The rescue wristband as set forth in claim 1, wherein the fastener is further defined by a clip.

3. The rescue wristband as set forth in claim 1, wherein the fastener is further defined by a knob.

4. The rescue wristband as set forth in claim 1, wherein the fastener is further defined by a micrometric fastener.

5. The rescue wristband as set forth in claim 1, wherein the fastener is further defined by a fastener-buckle.

6. The rescue wristband as set forth in claim 1, including a blowing valve.

7. The rescue wristband as set forth in claim 1, wherein the inflatable elastic buoyant chamber is sectional.

8. The rescue wristband as set forth in claim 1, wherein the gas generator formed from at least one of a plastic or a polyethylene.

9. The rescue wristband as set forth in claim 1, wherein the inner capsule and the outer capsule of the gas generator are separated from one another by a membrane.

10. The rescue wristband as set forth in claim 1, wherein the first solution is a water and a baking soda and the second solution is a aqueous solution of citric acid.

* * * * *